US005180209A

United States Patent [19]

Bieri

[11] Patent Number: 5,180,209

[45] Date of Patent: Jan. 19, 1993

[54] APPARATUS FOR CUTTING RECESSED GROOVES INTO CONCRETE AND ROCK MATERIAL

[75] Inventor: Hans Bieri, Pfaeffikon, Switzerland

[73] Assignee: Hydrostress AG, Pfaeffikon, Switzerland

[21] Appl. No.: 775,829

[22] Filed: Oct. 11, 1991

[51] Int. Cl.[5] ..... E21B 10/32

[52] U.S. Cl. ..... 299/41; 82/1.2; 175/292; 408/150; 409/200

[58] Field of Search ..... 299/41; 404/40, 51, 404/52; 175/285, 292; 52/396, 582, 585, 587; 82/1.2, 1.4, 1.5; 408/147, 150; 409/190, 200; 405/252

[56] References Cited

U.S. PATENT DOCUMENTS 1,998,015 4/1935 Heltzel ..... 404/40
3,422,705 1/1969 Nahodil et al. ..... 408/147
4,191,489 3/1980 Ray et al. ..... 404/51
4,874,046 10/1989 Hurd ..... 299/41

*Primary Examiner*—David J. Bagnell
*Attorney, Agent, or Firm*—W. G. Fasse

[57] ABSTRACT

Recessed grooves are cut into bore hole walls of concrete or rock materials for the purpose of interconnecting two components of such materials at an interface between these components. These recessed grooves are cut by material removing tools which can be pressed radially outwardly, while a drive shaft simultaneously rotates these tools. For this purpose, an axial movement of an adjustment body is converted into a tilting movement of pivotable shafts which carry the material removable tools, whereby the adjustment body is moved linearly by a hydraulic lifting device. The material removing tools extend radially away from the lower ends of the pivotable shaft. The common adjustment movement of all of the pivotable shafts takes place independently of the rotation of the driven shaft.

7 Claims, 7 Drawing Sheets

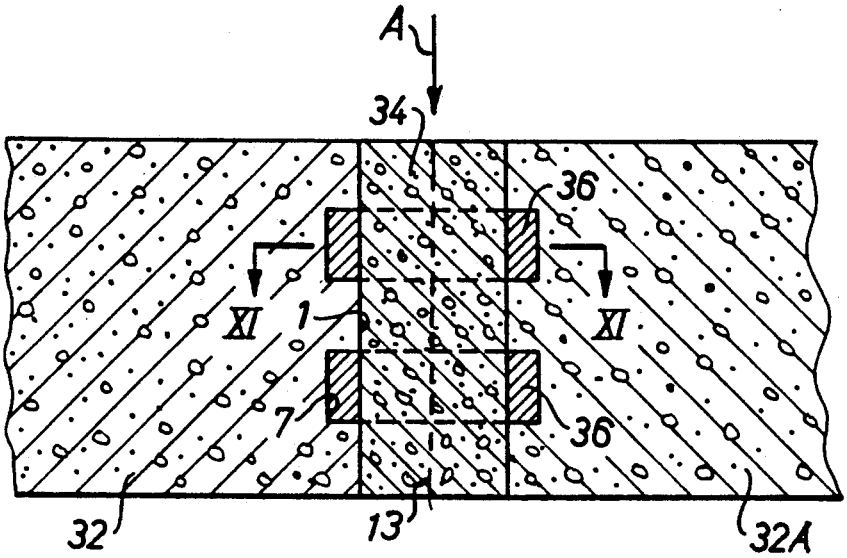
Fig. 10
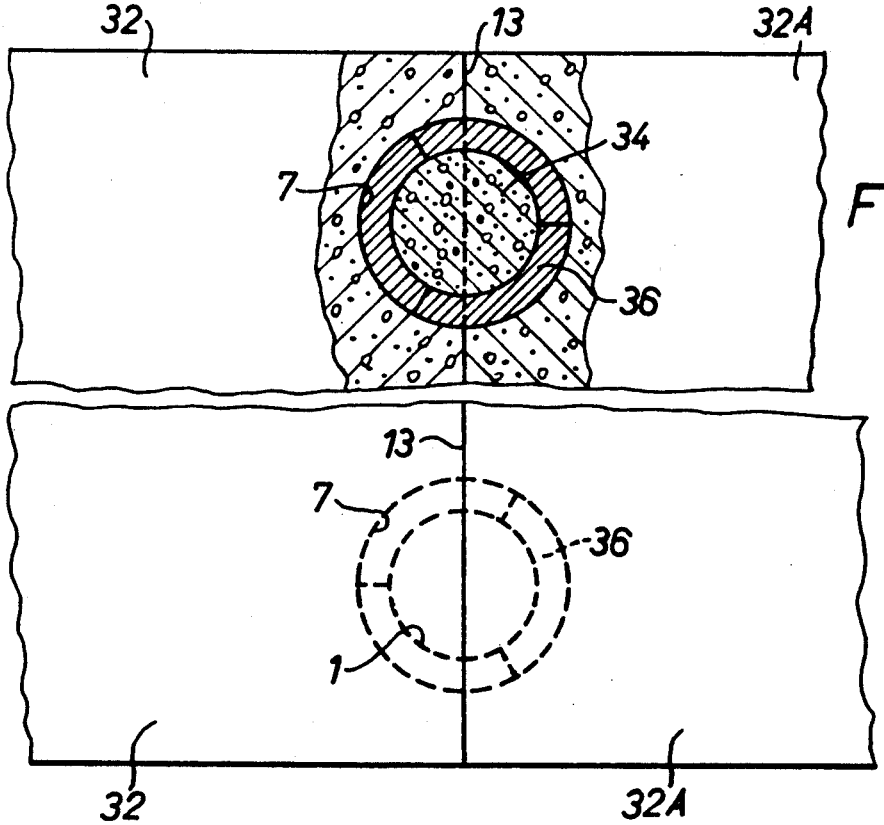
Fig.11A
Fig.11B

APPARATUS FOR CUTTING RECESSED GROOVES INTO CONCRETE AND ROCK MATERIAL

FIELD OF THE INVENTION

The invention relates to an apparatus for cutting recessed grooves into concrete and rock material, especially into bore hole walls of bores passing through an interface between two components of such materials.

BACKGROUND INFORMATION

In order to anchor mounting bolts or the like in a concrete slab or panel, it is desirable to provide bores in the slab with recessed grooves. Similarly, when two neighboring concrete slabs abutting against each other are to be anchored to each other, such recessed grooves are necessary in bores that pass through the interface between the two neighboring slabs. These bores extend preferably in such a way through the interface, that the central bore axis coincides with the plane of the interface and preferably also so that the bore axis extends perpendicularly to the surface of the two neighboring slabs.

For example, neighboring concrete slabs forming a road surface or runway, are to be anchored to each other in such a way that they cannot be displaced in the vertical direction relative to each other.

OBJECTS OF THE INVENTION

In view of the above it is the aim of the invention to achieve the following objects singly or in combination:

to provide an apparatus capable of cutting such recessed grooves into the bore hole walls in concrete and rock materials;

to rotate at least one, preferably several, material removing cutting tools, while simultaneously force-feeding the cutting tools radially outwardly for the formation of a recessed groove in a previously cut bore hole wall; and to construct a tool of the type mentioned in which the rotational drive and the radial feed advance motion is provided by different power sources.

SUMMARY OF THE INVENTION

The apparatus of the invention is characterized in that at least one or a plurality of pivotable shafts are arranged in parallel to a rotatable drive shaft, said pivotable shafts being rotatable with the rotatable shaft, wherein motion translation link members are provided for converting an axial motion of a linearly movable drive member into a common tilting or pivoting motion of the pivotable shafts independently of the rotational movement of the rotatable drive shaft, and wherein material removing tools are connected to the lower end zones of the pivotable shafts for cutting a recessed groove when the shafts pivot about their length axis.

By the features of the invention it is now possible to cut recessed grooves into hard materials, such as concrete and rock materials whereby the power drive in the rotational, as well as in the radial feed advance direction overcomes the difficulties encountered heretofore when concrete or rock materials had to be cut to form recessed grooves. Thus, the invention is, for example, well suited for interconnecting two concrete slabs.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 8:
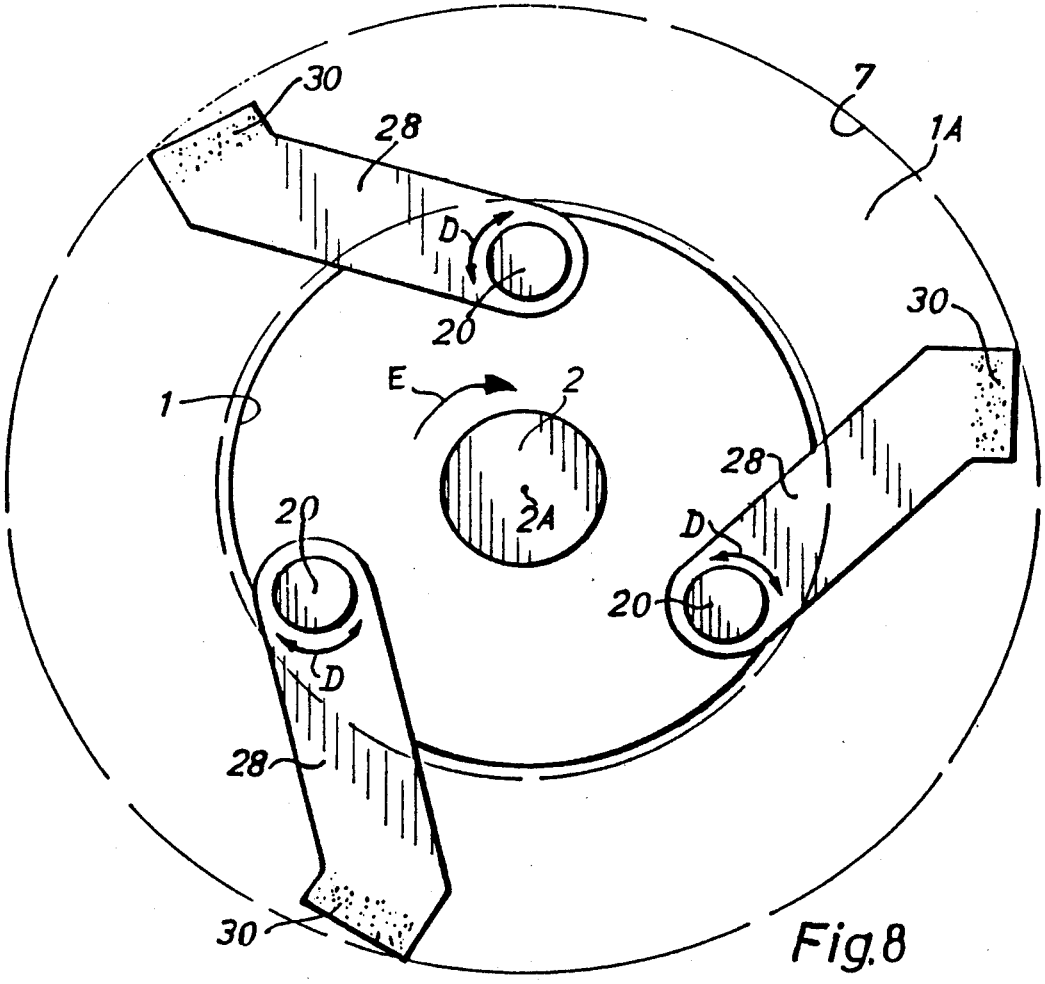
FIG. 8 is a view similar to that of FIG. 7, however, showing the material removing tools in a radially outward position corresponding to that of the motion translating members as show in FIGS. 4 and 6, whereby the view is approximately in the direction of the section plane VIII—VIII in FIG. 9B.
Figures 9A, 9B:
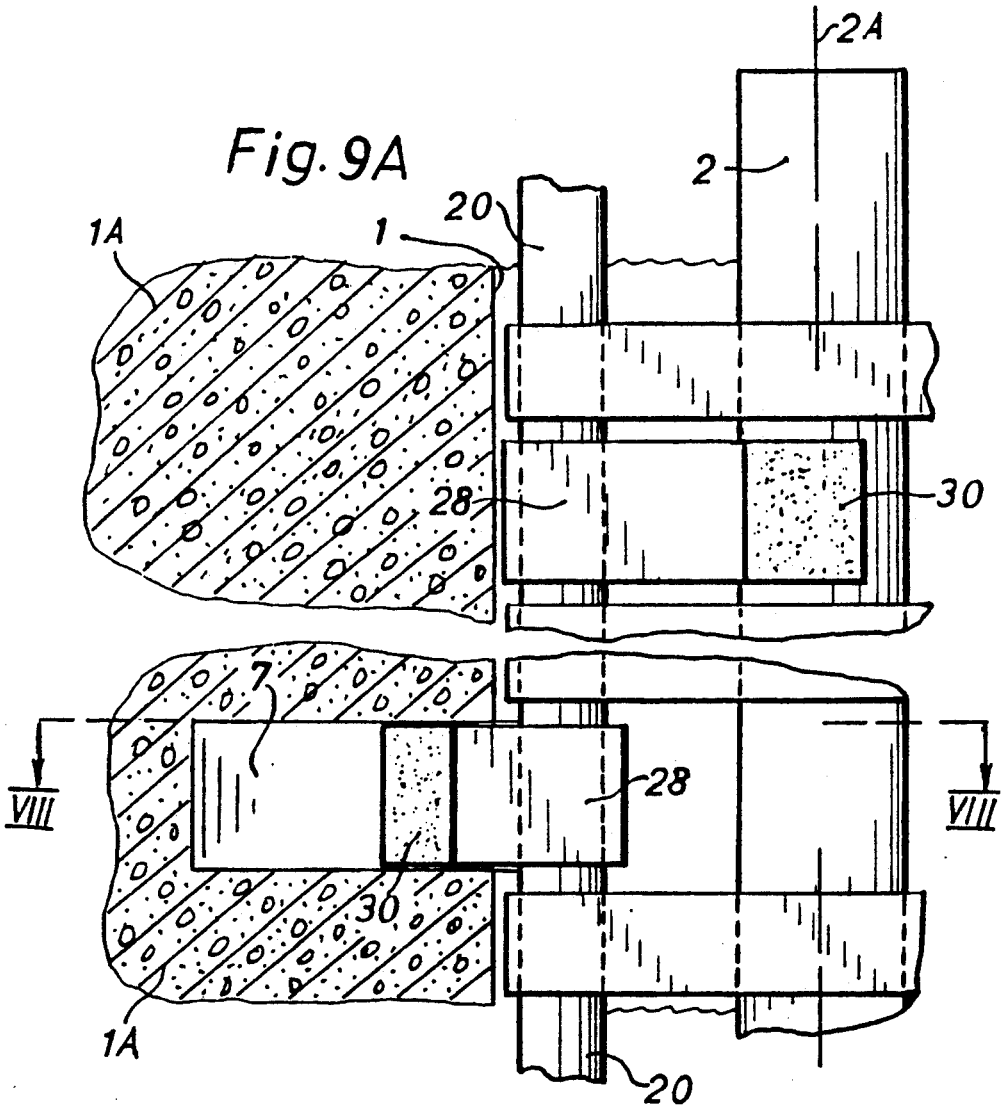
FIG. 9A shows a material removing tool in a withdrawn position corresponding to that of FIG. 7.
FIG. 9B shows the same tool in a partially radially outwardly extended position for cutting a groove.

Referring first to FIGS. 8, 9A, and 9B, the present apparatus is intended for producing recessed grooves 7 in concrete slabs 1A by removing material in a radially outward direction starting from a bore hole 1 previously drilled into the concrete slab. The radially outward direction has reference to a central axis 2A of the bore hole 1. The axis 2A is also the rotational axis of a drive shaft 2 that rotates material removing tools or cutters 28, 30 to be described in more detail below. The bore hole 1 is a cylindrical bore drilled by conventional equipment suitable for producing such holes in concrete or rock materials. So-called core drills or annular drills are suitable for this purpose. The diameter of the bore hole 1 is, for example, within the range of 80 to 150 mm, preferably about 100 mm.

Figure 1:
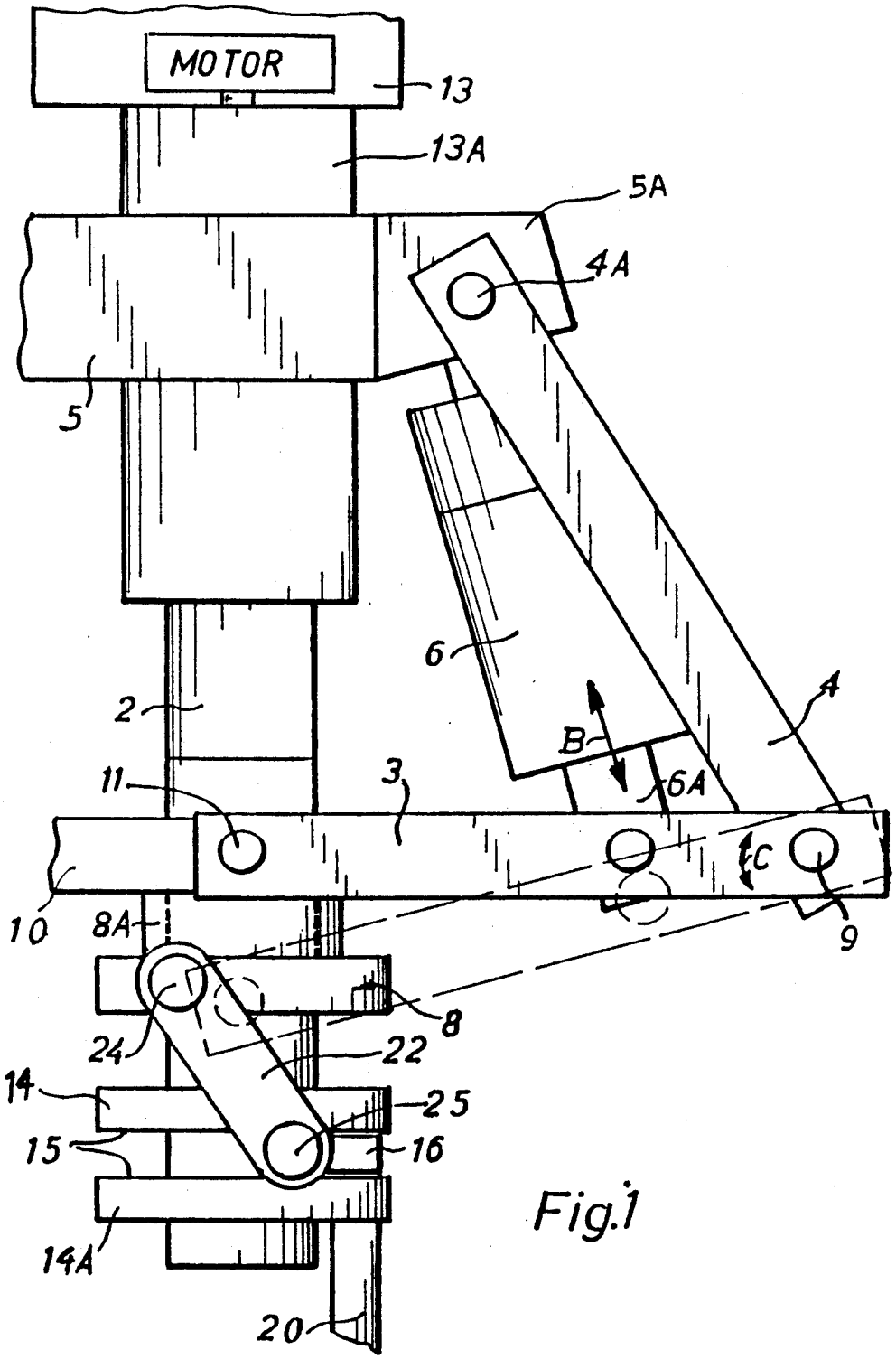
FIG. 1 is a side view of the present apparatus.
Figure 2:
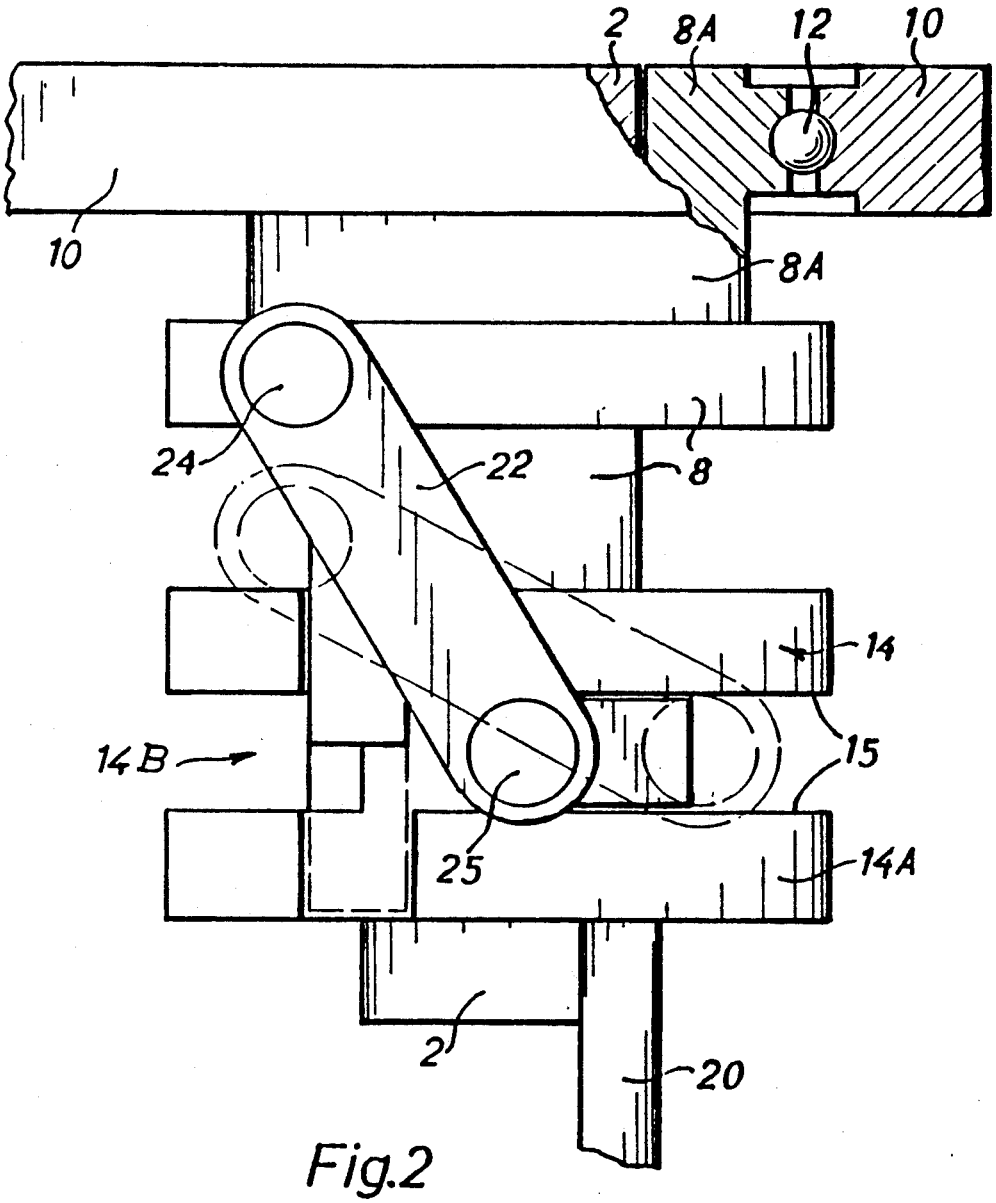
FIG. 2 is a view similar to that of FIG. 1, but showing motion translating members for the radial displacement of the material removing cutting tools.
Figure 3:
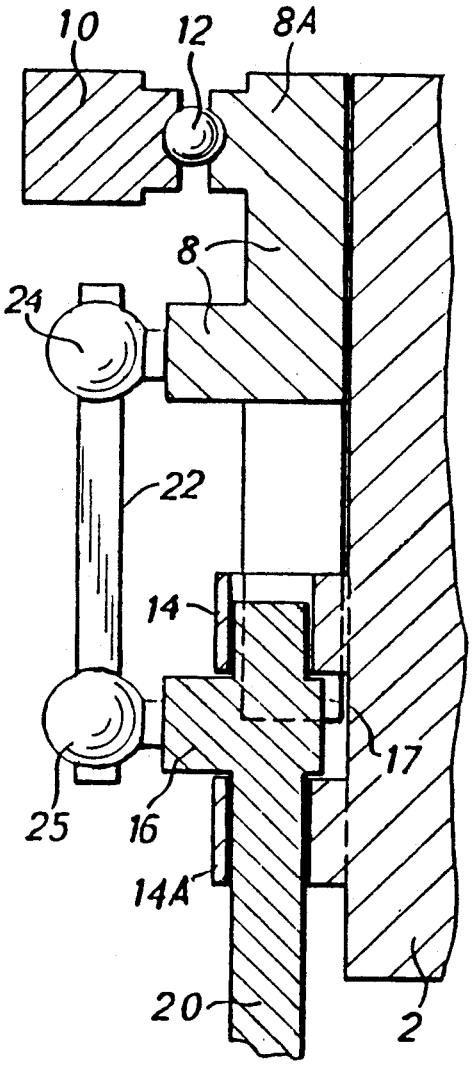
FIG. 3 is a vertical section through the translating members when the material removing tools are in a radially inward position.
Figure 4:
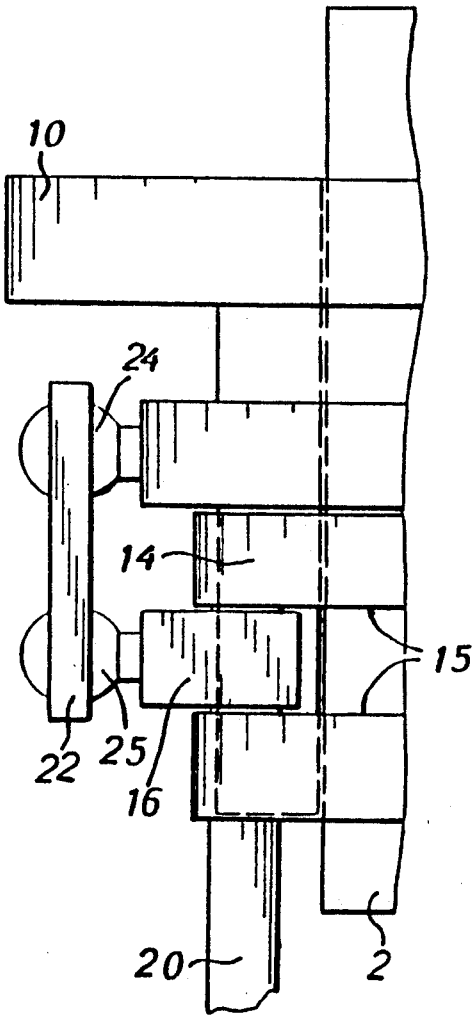
FIG. 4 is a vertical side view of the motion translating members in a position showing the material removing tool in a radially extended position, whereby the extension is approximately perpendicularly to the plane of the drawing.
Figure 5:
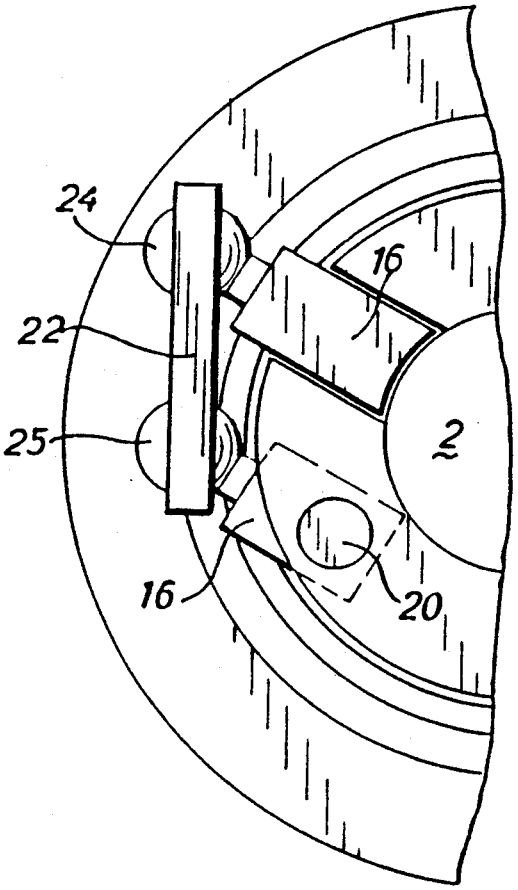
FIG. 5 is a view in the axial direction onto a broken-away portion of the motion translating members when these members are in the same position as shown in FIG. 3.

Referring to FIGS. 1 and 2, a housing or frame 13 carries a motor, such as an electric motor, for driving the rotatable drive shaft 2. The drive shaft 2 is mounted, for example, in ball bearings, (not shown) in a stationary guide bushing 13A. A forked collar 5 is rigidly secured to the bushing 13A. A lever 4 is hinged at 4A to an extension 5A of the collar 5. A forked double rocker lever 3 is journalled by a journal pin 9 to the lower end of the lever 4. The rocker lever 3 has two arms, one in front of the drive shaft 2, the other behind the drive shaft 2. The left-hand end of the rocker lever 3 is pivotally mounted by a journal coupling pin 11 to a drive ring 10 which is axially slidable up and down relative to the drive shaft 2, but which is not rotatable with the drive shaft 2. A drive mechanism 6, such as a hydraulic or pneumatic piston cylinder device is connected at its upper end to the extension 5A of the forked collar 5. The drive device 6 has a piston rod 6A movable up and down as indicated by the arrow B for tilting the rocker double lever 3 about the journal pin 9 as indicated by the arrow C to move the rocker lever 3 back and forth between the full line position and the dashed line position in FIG. 1. This movement of the rocker lever 3 is transmitted through the ring 10, through a ball bearing 12 capable of taking up and transmitting axial forces to a bushing 8A connected to an adjustment body 8 for applying radially outwardly or radially inwardly directed forces to material removing tools to be described in more detail below.

The following components serve for converting the linear movements of the piston rod 6A of the piston cylinder device 6 into a horizontal radially directed movement of the material removing tools 28, 30. As mentioned, the double rocker lever 3 is pivoted by horizontally extending journal pins 11 to the nonrotatable ring 10 that surrounds the ring bushing 8A which in turn surrounds the drive shaft 2. The ring 10 is axially movable relative to the shaft 2 by the movement of the rocker lever 3. Due to the ball bearing 12, only the bushing 8A and the adjustment body 8 are both axially movable and rotatable with the rotation of the drive shaft 2. A guide ring 14, 14A is arranged below the adjustment body 8 and rigidly connected to the drive shaft 2 for rotation with the drive shaft 2. The guide ring has an upper section 14 and a lower section 14A axially spaced from each other to form a guide groove 14B between axially facing guide surfaces 15, which are preferably lubricated or otherwise provided with a low fiction surface. The adjustment body 8 is connected through a tongue with the shaft 2 so that the adjustment body 8 can rotate with the shaft 2 while being axially movable relative to the shaft 2 by reason of the ball bearing 12.

A plurality of pivotable shafts 20 is rotatably mounted to the guide ring 14. These pivotable shafts 20, for example three, are uniformly distributed around the circumference of the guide ring 14. In the position shown in FIGS. 1 and 2, the tilting or pivotable shafts 20 extend in parallel to the drive shaft 2. In this position, the axial drive force transmitting rocker lever 3 is in the full line position shown in FIG. 1. The pivotable shafts 20 assume a radially outwardly tilting position when the rocker lever 3 assumes the dashed line position in FIG. 1 under the drive of the piston rod 6A. The upper end of each pivotable shaft 20 is provided with a respective radially extending projection 16 which is received in the guide groove 14B between the guide surfaces 15. There should be as little play as possible between the guide surfaces 15 and the projection 16.

Figure 6:
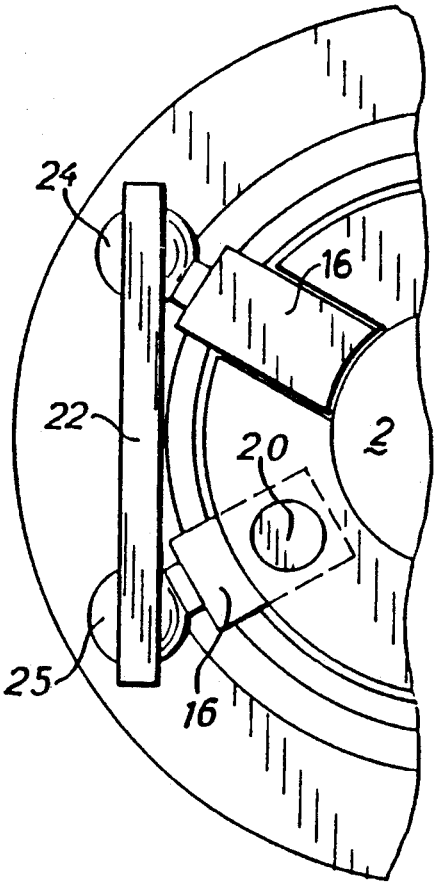
FIG. 6 is a view similar to that of FIG. 5, however, showing the motion translating members in a position corresponding to that of FIG. 4.

The transmission of the motion of the rocker lever 3 to the pivotable shafts 20 takes place through the adjustment body 8 and the guide ring 14. For this purpose, the guide ring 8 is connected to a coupling plate 22 by a ball joint mechanism 24. Similarly, the lower end of the coupling plate 22 is connected to the guide groove 14B by a ball joint 25. Thereby, each coupling plate 22 is pivotable about an axis of ball joint 24 and about an axis of ball joint 25. FIGS. 1, 2, 3, and 5 illustrate a condition in which the adjustment body 8 is in an uppermost position. When now an axial movement is applied to the adjustment body 8 by the rocker lever 3 moving from the full line position into the dashed line position shown in FIG. 1, the adjustment body 8 will tilt the coupling plates 22 into the dashed line position shown in FIG. 2. Since the guide ring 14 is rigidly connected for rotation with the shaft 2, but without being able to move axially relative to the shaft 2, a pivoting motion is applied by the coupling plate 22 to the shafts 20 as indicated by the arrows D in FIG. 8, thereby moving the cutting tools 28, 30 radially outwardly. Please also compare FIGS. 5 and 6. The coupling plate 22 does not become shorter or longer, but rather is seen at a different angle when comparing FIGS. 5 and 6 with each other. The tilting angle amounts to approximately 40° to 50°, preferably 45° around the longitudinal axis of shaft 20.

As shown in FIG. 8, a material removing tool 28 carrying a grinding shoe 30 is rigidly secured to the lower free end of each tiltable shaft 20. The grinding shoes 30 are, for example, carrying diamond splinters embedded in a suitable bedding material of conventional composition. All tools 28 are secured in the same horizontal plane for cutting the groove 7 when the tools are tilted outwardly as shown in FIG. 8, and when the shaft 2 is rotating clockwise as shown in FIG. 8 by the arrow E.

Figure 7:
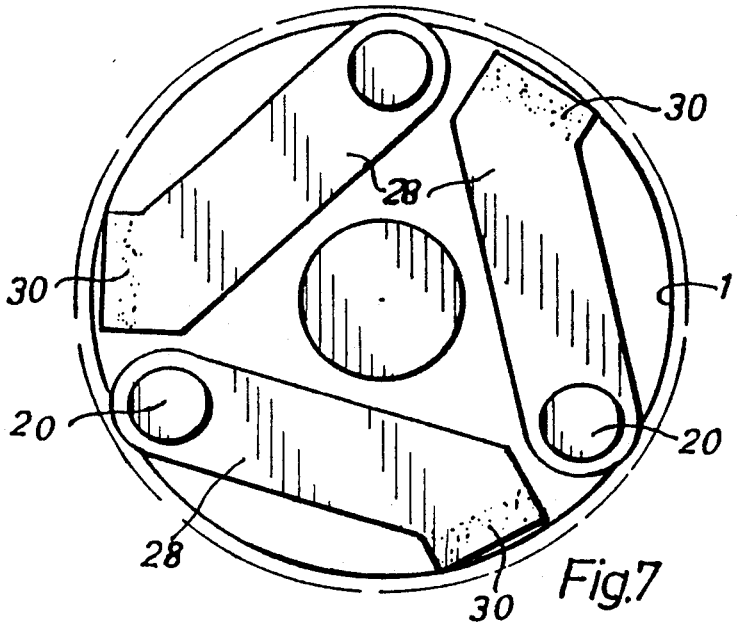
FIG. 7 is a top plan view of the material removing tools when these tools are in their radially pulled-in position in which the motion translating members are shown in the position of FIGS. 3 and 5.

FIG. 7 shows the tools 28 in the fully retracted condition which corresponds to the full line position of the rocker lever 3 in FIG. 1. FIG. 8 shows all three tools 28 in the fully radially extended position. In the fully retracted position the tools 28 with their shoes 30 are so positioned that they fit into the diameter of the bore hole 1. The tool is then lowered to the desired extent and the shaft position of the drive shaft 2 is then fixed at the desired level when rotation of the shaft begins and a force is applied through the piston cylinder device 6.

Once the groove 7 is completed, the tools 28 with their shoes 30 are again withdrawn by rotating the shafts 20 in a direction opposite t the direction D to bring the tools back into the position of FIG. 7, whereupon the tool may be withdrawn from the bore hole 1.

However, several grooves at vertically different levels may be cut by the present apparatus, whereby the level of the shaft 2 is preferably mechanically adjustable and lockable so that an axial force will not be applied to the tools 28 when the latter are cutting a groove. When the radial depth of the groove 7 is reached, the radially inward withdrawal of the tool permits the adjustment of the shaft to a higher or lower level for the cutting of further grooves, if desired.

FIG. 9A shows the position of the tool 28, 30 just prior to the cutting, while FIG. 9B shows the tool 28, 30 either in a position ready to be withdrawn, in which case the groove 7 has been finished or is in a position under a radially outward drive, in which case the groove has not yet been finished.

The shape of the grinding shoes 30 can be selected in accordance with the requirements as dictated by the materials to be cut and by other considerations such as the groove dimensions. The tip of the shoes could be a half-round or a pointed tip. A tip that would produce a recessed groove 7 with a trapezoid type of cross-section is also possible.

When anchors are to be mounted in a bore hole with a groove produced as disclosed herein, the anchors may have flange sections so formed as to permit the insertion through the bore hole 1 so that these flange sections can then engage radially outwardly into the groove.

Although the invention has been described with reference to specific example embodiments it will be appreciated that it is intended to cover all modifications and equivalents within the scope of the appended claims.

I claim is:

1. An apparatus for cutting recessed grooves into concrete and rock material, comprising at least one material removing tool, rotatable drive means for rotating said tool, at least one pivotable shaft arranged in parallel to a rotatable drive shaft, means for rotating said pivotable shaft together with the rotatable drive shaft, radial tool drive means including motion translation link members arranged for converting an axial motion of a linearly movable drive device into a pivoting motion of said pivotable shaft about its own longitudinal axis independently of any rotation of said rotatable drive shaft, said material removing tool being connected to a lower end of said pivotable shaft for cutting a recessed groove, and wherein said tool drive means comprise an adjustment body mounted for rotation with said drive shaft and axially displaceable along said drive shaft, means connecting said adjustment body to said drive device for moving said adjustment body axially, guide means mounted on said drive shaft with an axial spacing from said adjustment body and connected with said drive shaft for rotation with said drive shaft, means extending radially for mounting said at least one pivotable shaft in said guide means for pivoting said at least one pivotable shaft about its own longitudinal axis within a limited pivot angle, and motion translating members arranged between said pivotable shaft and said adjustment body for pivoting said at least one pivotable shaft when said drive device is activated to thereby move said material removing tool radially.

2. The apparatus of claim 1, wherein at least three material removing tools are connected to respective three pivotable shafts, said tools and shafts being arranged with uniform angular spacings around said drive shaft.

3. The apparatus of claim 2, wherein each of said three material removing tools uniformly distributed around the circumference of said drive shaft, comprises a grinding shoe secured to an end portion of the respective material removing tool.

4. The apparatus of claim 1, wherein said motion translating means comprise a drive member and a rocker lever connecting said drive member to said drive device including a non-rotating hydraulic or pneumatic drive member secured to a machine frame.

5. The apparatus of claim 1, wherein said mounting means for said pivotable shaft comprise radially projecting extensions at an upper end of the respective pivotable shaft, said extension being guided between guide slide surfaces of said guide means.

6. The apparatus of claim 5, wherein said motion translating members comprise ball joints for transmitting an adjustment motion of said adjustment body and said radially projecting extensions, said ball joints being interconnected by a coupling plate pivoted to said ball joints.

7. An apparatus for cutting recessed grooves into concrete and rock material, comprising at least three material removing tools, rotatable drive means for rotating said tool, at least one pivotable shaft arranged in parallel to a rotatable drive shaft, means for rotating said pivotable shaft together with the rotatable drive shaft, radial tool drive means including motion translation link members arranged for converting an axial motion of a linearly movable drive device into a pivoting motion of said pivotable shaft about its own longitudinal axis independently of any rotation of said rotatable drive shaft, said material removing tool being connected to a lower end of said pivotable shaft for cutting a recessed groove, and wherein said at least three material removing tools are connected to respective three pivotable shafts, said tools and shafts being arranged with uniform angular spacings around said drive shaft.

* * * * *

UNITED STATES PATENT AND TRADEMARK OFFICE

CERTIFICATE OF CORRECTION

PATENT NO. : 5,180,209

DATED : Jan. 19, 1993

INVENTOR(S) : Hans Bieri

It is certified that error appears in the above-identified patent and that said Letters Patent is hereby corrected as shown below:

Please delete Figures 10, 11A and 11B in the drawings.

Signed and Sealed this

Fourteenth Day of December, 1993

Bruce Lehman

*Attest:*

BRUCE LEHMAN

*Attesting Officer*

*Commissioner of Patents and Trademarks*